United States Patent [19]

Moertel

[11] 4,263,699

[45] Apr. 28, 1981

[54] SLIDER AND SLIDE FASTENER

[75] Inventor: George B. Moertel, Conneautville, Pa.

[73] Assignee: Textron, Inc., Meadville, Pa.

[21] Appl. No.: 29,520

[22] Filed: Apr. 12, 1979

[51] Int. Cl.[3] ..... A44B 19/00

[52] U.S. Cl. ..... 24/205.15 R; 24/205.14 R

[58] Field of Search ..... 24/205.14 R, 205.15 R, 24/205.13, 205.14 A, 205.14 K

[56] References Cited

U.S. PATENT DOCUMENTS

| | | | |
|---|---|---|---|
| 1,853,634 | 4/1932 | Norton | 24/205.14 R |
| 1,890,336 | 12/1932 | Nodine | 24/205.14 R |
| 2,279,767 | 4/1942 | Ulrich | 24/205.14 R |
| 2,287,349 | 6/1942 | Hirsch | 24/205.14 R |
| 2,288,760 | 7/1942 | Williams | 24/205.14 R |
| 2,327,562 | 8/1943 | Schaaff | 24/205.13 |
| 2,552,394 | 5/1951 | Bloxsom | 24/205.14 A |
| 2,591,948 | 4/1952 | Lawson | 24/205.14 |
| 2,838,969 | 6/1958 | Simmons, Sr. | 24/205.15 R |
| 2,862,274 | 12/1958 | Morin | 24/205.15 |
| 3,067,476 | 12/1962 | Cromberg et al. | 24/205.13 X |
| 3,089,328 | 5/1963 | Clauss | 24/205.14 X |
| 3,226,788 | 4/1966 | Samberg et al. | 24/205.14 R |
| 3,449,803 | 6/1969 | Manning | 24/205.14 R |
| 3,798,714 | 3/1974 | Mueller | 24/205.14 |
| 3,823,446 | 7/1974 | Labecki | 24/205.14 R |
| 3,968,545 | 7/1976 | Kawashima | 24/205.15 R |

*Primary Examiner*—Roy D. Frazier
*Assistant Examiner*—Peter A. Aschenbrenner
*Attorney, Agent, or Firm*—O'Brien and Marks

[57] ABSTRACT

Sliders for slide fasteners are disclosed including (1) one or more locking projections extending into outer lateral regions of a main slider channel portion, (2) an inclined divider post, (3) lateral tabs for enabling assembly of pull-less slider, and/or (4) an asymmetric locking projection on a divider post.

43 Claims, 19 Drawing Figures

PRIOR ART

SLIDER AND SLIDE FASTENER

TECHNICAL FIELD

The invention relates to sliders and to slide fasteners which employ such sliders for opening and closing openings in articles, such as covers on a car seat, etc.

BACKGROUND ART

The prior art, as exemplified in U.S. Pat. Nos. 1,853,634, 1,890,336, 2,327,562, 2,591,948, 2,862,274, 3,067,476, 3,089,328, 3,226,788, 3,449,803, 3,798,714, 3,823,446, 3,968,545 and 4,048,698, contains a number of sliders for slide fasteners and/or slide fasteners employing such sliders. Generally, a slider for a slide fastener, as indicated generally at 42 in FIG. 7, includes two wing members (only one wing member 44 shown in FIG. 7) which are held in a parallel, spaced overlying relationship by a connecting divider post 46 extending between and connecting one ends of the wing members. Flanges 48 and 50 on lateral edges of one or both of the wing members extend toward the other wing member or members and in combination with the divider post and inner surfaces of the wing members define a Y-shaped channel through which fastening elements 34 and 36 on inner edges of carrier tapes 30 and 32 pass in opening and closing of the slide fastener. Parallel portions 52 and 54 of the flanges 48 and 50 define a main channel portion 56 of the Y-shaped channel for receiving the slide fastener elements on the opposite tapes in an interlocking condition. The remaining portions 58 and 60 of the flanges diverge outwardly on opposite sides of the divider post to form, in combination with the divider post, two divided or branch channel portions 62 and 64 of the Y-shaped channel.

The above U.S. Pat. Nos. 1,890,336, 3,226,788, 3,449,803, 3,798,714 and 3,823,446 disclose locking projections on the outer ends of the diverging flange portions of the slider. These prior art flange locking projections must be positioned on the outer ends of diverging flange portions away from the inner regions of the branch channel portions to avoid lockingly engaging the fastening elements during normal opening and closing movement and to avoid forcing the fastening elements against the inner surfaces of the divider post and making slider movement more difficult. The above U.S. Pat. No. 1,853,634 and No. 2,591,948 disclose notches formed on the inside surfaces of the diverging flange portions. The notches are recessed from the normal surfaces of the flanges engaged by the fastening elements during movement of the slider, and where the notches are adjacent the inner regions of the branch channels, any substantial projections into such regions must be avoided or else undesired locking of the slider or greatly difficult slider movement results. These prior art projections and notches only lockingly engage the heel portions of the coupling elements when the slide fastener tapes are pulled apart above the slider. In some articles, for example car seat covers, the upper ends of the tapes are sewn together preventing the upper ends from spreading and thus rendering the locking features of such sliders ineffective. Additionally these prior art sliders generally require additional steps in forming the projections or notches such as bending, deforming, etc., or require complex die casting mechanisms.

The above U.S. Pat. No. 4,048,698 discloses a locking pawl with a portion arranged centrally in one wing and formed by making cuts in the wing and by bending a part of this wing into an inverted V-shaped configuration. This pawl, besides requiring the extra cutting and bending steps, also requires very close tolerances with the fastening elements on the tapes of the slide fastener in order to engage the fastening elements while permitting movement of the slider on the slide fastener. To produce such close tolerances, the dimensions of the slider as well as the dimensions of the fastening elements must be carefully controlled in manufacture since variations in these sizes can cause the locking pawl to be ineffective or greatly increase the force required to move the slider on the slide fastener elements. Furthermore, to be effective, this locking pawl must engage the slide fastener elements at all times resulting in increased forces required to move the slider.

The working edges or working surfaces formed on innermost portions of the connecting divider posts facing the main channel portions in the prior art generally either extend straight and perpendicular between the inner faces of the wing members or, as illustrated in the above U.S. Pat. No. 3,067,476 and No. 3,798,714, extend from superposed positions at the inner surfaces of the wing members at opposite and equal outwardly extending oblique angles to form centrally disposed notches in the divider post which have their deepest penetration along a plane parallel and centered between the wing members.

In larger size prior art slide fasteners employing coil or spiral coupling elements, the sliders tend to hang up or stop during opening movement of the slider. These coil-type or spiral-type slide fasteners employ fastening elements, such as 34 and 36 in FIG. 7, which are formed from convolutions of respective coils of monofilament thermoplastic configured in a conventional manner. In forming the tapes 30 and 32, weft or filling threads are passed around connecting portions of the monofilament coils between the fastening elements 34 and 36 and are also interwoven with a plurality of warp threads surrounding a cord to form beads 38 and 40 on inner edges of the tapes supporting the fastening elements 34 and 36. Because of the tendency for slider hang up, larger sizes of spiral-type slide fasteners have generally not been commercially successful.

The above U.S. Pat. No. 2,327,562 discloses a divider having a working end which is bluntly rounded to provide a spreading angle for the slide fastener stringers which is obtuse rather than acute as produced by more pointed working ends; this greater spreading angle permits employment of the slider on a slide fastener with the locking projections of the fastening elements pointing in a direction away from the divider, which is the reverse of the conventional direction of the locking projections. The above U.S. Pat. No. 2,591,948 shows a heart-shaped spring assembled around the divider post for forcing the heel portions of coupling elements into notches in the outwardly extending portions of the flanges.

The above U.S. Pat. No. 2,862,274 discloses a slider with a ridge or platform extending on one wing member from the working edge or surface of the divider post for maintaining the fastening elements or scoops in proper position for coupling engagement during the closing movement of the slider. This ridge is illustrated as causing a tilting movement of the fastening element within the slider channel which is formed with a larger dimension relative to the size of the fastening elements in order to avoid jamming of the slide fastener caused by foreign elements or garment flaps in the slider channels.

The above U.S. Pat. No. 3,089,328 discloses a bolt movable by a cam for extending from the divider post into a center portion of the main channel in the slider to block movement of the fastening elements therethrough and thus lock the slider on the side fastener.

SUMMARY OF THE INVENTION

In a first aspect, the invention is summarized in a slider for a slide fastener which has a chain including a pair of tapes and interlocking fastening elements mounted on inner edges of the tapes for being opened and closed by the slider, the slider including first and second spaced and superposed wing members each having first and second ends, a connecting divider post extending between and joining the first ends of the first and second wing members, flanges on opposite sides of at least one of the wing members and extending toward the other wing member, the flanges and the post defining a Y-shaped channel between the wing members, the Y-shaped channel having a main channel portion and two branch channel portions which diverge from the main channel portion on opposite sides of the divider post, a projection formed on an interior wall of the slider in the main channel portion, and the projection extending into an outer portion of the main channel portion for engaging a portion of the chain of the slide fastener to retard opening movement of the slider.

In a second aspect, the invention is summarized in a slider for a slide fastener which has a chain including a pair of tapes and interlocking fastening elements mounted on inner edges of the tapes for being opened and closed by the slider, the slider including first and second spaced and superposed wing members each having first and second ends, a connecting divider post extending between and joining the first ends of the first and second wing members, flanges on opposite sides of at least one of the wing members and extending toward the other wing member, the flanges and the post defining a Y-shaped channel between the wing members, the Y-shaped channel having a main channel portion and two branch channel portions which diverge from the main channel portion on opposite sides of the the divider post, the connecting divider post having a surface which includes a substantially straight line extending between the first and second wing members, the line defining the division between two branch channel portions, and the line extending at an oblique angle to the first and second members.

An object of the invention is to construct a relatively inexpensive and reliable self-locking slider for a slide fastener.

Another object of the invention is to construct a slider which has less tendency to hang up during opening movement of the slider.

It is also an object of the invention to construct a self-locking slider which will lock upon upper ends of slide fastener stringers which are secured together.

An advantage of the invention is that a complete slider can be made by one die-casting procedure.

Another advantage of the invention is that the necessity of separate assembly steps for providing locking features such as locking springs and caps, etc. are eliminated.

Additional features which may be included in the invention or which may be considered as separate aspects of the invention are the elimination of the pull member normally attached to sliders in combination with the provision of integral tabs projecting laterally from a wing member of the slider for being engaged by a holder during assembly of the slider on a slide fastener chain, and the provision of a pointed projection formed on a divider post of the slider for extending assymetrically into the slider channel to permit elements to pass when the slider is closed but preventing movement of the elements when the slider is open.

Other objects, advantages and features of the invention will be apparent from the following description of the preferred embodiments taken in conjunction with the accompanying drawings.

DESCRIPTION OF THE PREFERRED EMBODIMENT

Figure 1:
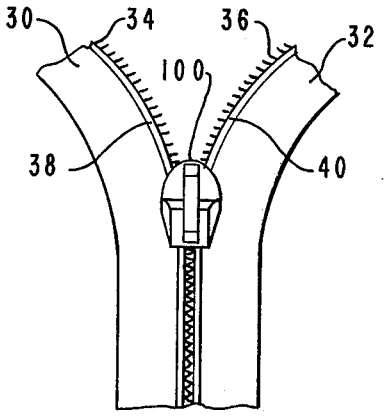
FIG. 1 is a plan view of a slide fastener, with end portions broken away, in accordance with the invention.

As illustrated in FIG. 1, the invention is embodied in a slide fastener including a pair of carrier tapes 30 and 32 having rows of fastening elements 34 and 36 secured on innerbeaded edges 38 and 40 of the tapes with a slider 100 slidably mounted on the inner edges of the tapes for opening and closing the elements 34 and 36 from engaged and disengaged conditions. The tape 30 and fastening elements 34 form a left stringer while the tape 32 and fastening elements 36 form a right stringer for the slide fastener. The left and right stringers, when the elements 34 and 36 are engaged or interlocked, form a chain for the slide fastener. The chain illustrated in FIG. 1 is a conventional chain which has the elements 34 and 36 formed by configured convolutions of respective coils of thermoplastic monofilament woven into the beaded edges 38 and 40 of the tapes 30 and 32 during the weaving of the tapes. Other types of conventional slide fastener chains can be substituted for the described woven spiral chain.

The construction of the slider 100 is shown in FIGS. 2, 3, 4 and 5. The slider includes an upper wing member 102, a lower wing member 104 and a divider post 106 extending between and connected to left end portions of the wing members 102 and 104. The wing members 102 and 104, generally, are spaced, parallel and superposed. An extension 108 extends upward from the upper surface of the wing member 102 along a portion disposed centrally between the sides thereof and extending from the left end to the right end of the member 102. An opening 110 is formed through the extension 108 for receiving a portion of a tool (not shown) which can be used to move the slider on the slide fastener chain. Flanges 112 and 114 extend downward from respective opposite side edges of the upper wing member 102 toward the lower wing member 104 while flanges 116 and 118 extend upward from respective opposite side edges of the lower wing member 104 104 toward the upper wing member 102. The flanges 112 and 116 on one side of the slider are parallel and spaced from each other leaving a narrow slot therebetween for receiving the tape 30 but preventing outward lateral movement of the bead 38 and coupling elements 34, and the flanges 114 and 118 on the opposite side of the slider are parallel and spaced from each other leaving a similar narrow slot therebetween for receiving the tape 32 but preventing outward lateral movement of the bead 40 and fastening elements 36.

The flanges 112, 114, 116 and 118 in combination with the divider post 106 define a generally Y-shaped channel (as viewed from the right side of FIGS. 3 and 4) through the slider. The flanges 112, 114, 116 and 118 have respective portions 122, 124, 126 and 128 which are all parallel to each other and extend from the end of the slider opposite the post 106 to define a common or main portion 130 of the Y-shaped channel which has a generally rectangular cross section and substantial length for receiving and guiding the fastening elements 34 and 36 and beads 38 and 40 when the fastening elements 34 and 36 are interlocked. The remaining portions 132, 134, 136 and 138 of the respective flanges 112, 114, 116 and 118 diverge laterally outward from the inner ends of the parallel flange portions 122, 124, 126 and 128. The diverging flange portions 132 and 136 on one side of the slider form, in combination with one side of the divider post 106, a branch channel portion 140 while the diverging flange portions 134 and 138 on the opposite side of the slider form, in combination with the other side of the divider post 106, a second branch channel portion 142. The branch channel 140 receives the fastening elements 34 and bead 38 of the left stringer and the branch channel 142 receives the fastening elements 36 and bead 40 of the right stringer as these stringers diverge apart from the point of disengagement within the slider.

Figure 17:
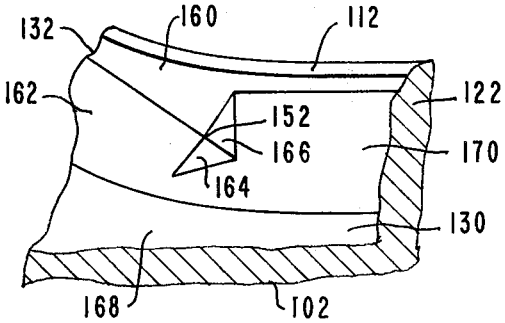
FIG. 17 is perspective view of a broken-away portion of the slider of FIGS. 2–5 particularly showing a locking projection.

Locking projections 152, 154, 156 and 158 extend into outer lateral regions of the main channel portion 130. These projections may be mounted on any of the adjoining inner wall surfaces of the wing members or flanges but it is preferred that the projections be mounted as shown, i.e., on the inner surfaces of the respective flanges 112, 114, 116 and 118. The projections are positioned in the end of the main channel portion 130 at or adjacent the intersection where the Y-shaped channel branches into the channel portions 140 and 142. As shown in FIG. 17, the locking projection 152 terminates at a pyramidal point formed by a common intersection or apex of four corners of respective surfaces 160, 162, 164 and 166. The surface 160 extends inward from an inner distal edge of the flange 112 toward the central portion of the wing member 102. The inner distal edge of the flange 112 may be rounded or beveled. The surface 162 is a continuation of a surface on the inside of the outwardly flaring flange portion 132 which extends substantially perpendicular to an inside surface 168 of the upper wing member 102. The surface 164 is a generally triangular surface which has one edge common with an edge of the surface 162 and its edge opposite the top of the projection 152 near or lying in a rounded junction between the surface 162 of the flange portion 132 and an inner surface 170 of the wing portion 122 which also extends substantially perpendicular to the surface 168. The surface 164 extends generally parallel to the direction of the main channel portion 130 but obliquely or at acute angles to the flange 122 and the surface 168. The surface 166 is a triangular surface having one edge common with an edge of the surface 164 and extending from the tip of the projection 152 to an edge in the surface 170 generally perpendicular to the surface 168. The third side of the surface 166 forms a common edge with the surface 160. The other projections 154, 156 and 158 have a substantially similar configurations forming pyramidal points.

Figure 11:
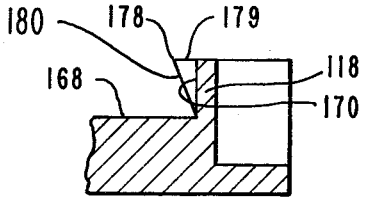
FIG. 11 is a cross-section view of a portion of a variation of the sliders shown in FIGS. 5 and 10.
Figure 12:
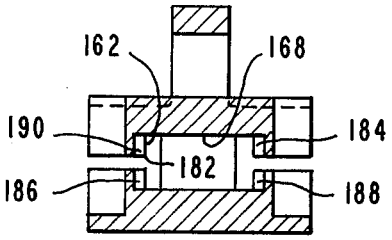
FIG. 12 is a cross-section view similar to the view of FIG. 5 but of a second modified slider in accordance with the invention.
Figure 18:
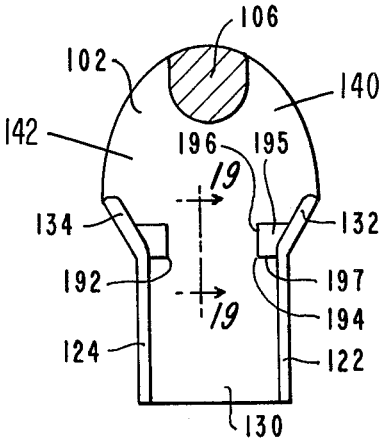
FIG. 18 is a cross-section view similar to FIG. 4 illustrating still another variation of the slider in accordance with the invention.
Figure 19:
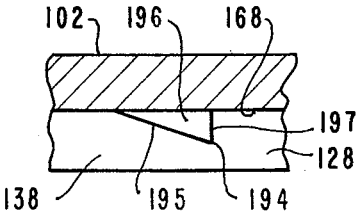
FIG. 19 is a cross-section view of a portion of the slider of FIG. 18 taken at line 19—19 in FIG. 18.

The locking projections extending into the main channel portion 130 of the slider may have many different configurations, some of which are illustrated in the sliders of FIGS. 10, 11, 12, 18 and 19. The slider of FIG. 10 has only two locking projections 152 and 154 which extend inward from the diagonally opposite flanges 112 and 118; sliders with less or more of the locking projections extending into a lateral outer region or regions of the main channel portion 130 are possible. In FIG. 11, a locking projection 178 has an upper surface 179 which extends from the upper edge of the flange 118 generally parallel the surface 168 rather than being canted downward as shown for the projection 158 in FIGS. 5 and 10, and has an inner surface 180 which extends to the intersection of the surfaces 168 and 170 rather than to a line intermediate in the surface 170. The slider of FIG. 12 has four locking projections 182, 184, 186 and 188 which have their tips formed by the common corners of only three surfaces, two of which corners are right angle corners. The surface 162 extends to a common edge with a rectangular surface 190, this edge extending generally perpendicular to the surface 168 of the upper wing member. In FIGS. 18 and 19, projections 192 and 194 are formed without any surfaces common with the inner surfaces of the diverging flange portions 132 and 134 or common with the surfaces of the flange portions 122 and 124. The projections 192 and 194 have one surface 195 which extends downwardly at an incline from the upper wing member 102 at the respective diverging channel portions 140 and 142 into the main channel portion 130 toward the opposite end of the slider. A surface 196 perpendicular to the surface 168 and parallel to the main channel portion 130, and a surface 197 generally perpendicular to the main channel 130 define the other limits of the projections 192 and 194.

The locking projections are formed with a size and sharpness on their protruding point or edge sufficient to engage portions of the chains of the slide fastener when the tapes 30 and 32 are subject to crosswise forces, i.e., forces pulling the tapes 30 and 32 apart. The angles and configurations of the various sides and surfaces of the projections shown in FIGS. 2–5, 10–12 and 17–19 are selected so that weft or filling threads in the beads 38 and 40 are engaged sufficiently to retard opening movement of the slider but not to prevent opening movement of the slider when the slider is pulled with a force in the opening direction. The surfaces of the locking projections facing toward the post 106 are all inclined along the direction of movement of the stringer through the slider during closing movement of the slider so that the slide fastener chain easily slips past the projections during closing movement of the slider.

The distance that the projections extend to the main channel portion and the angle of the engaging or locking surface of the projection (surface 166 of the projection 152 in FIG. 17) particularly determine the degree of retarding force on the slider. The locking surface may be about perpendicular or may be slightly undercut (i.e., canted from the inner wall in a direction opposite to the opening movement of the slide fastener chain through the main channel portion of the slider); such undercut must not be great enough to snag the weft threads and prevent the weft threads from slipping off of the projection 152 during opening movement of the slider. For the projection 152, having the surface 166 undercut to form an angle in the range from 60° to 80° with the surface 170 produces excellent gripping action on a textile bead when the projection extends about 0.35 mm (0.014 inches) from the surface 170 and the included angle of the projection tip between surfaces 160 and 164 is in the range from 70° to 90° with the surface 160 canted toward the wing member at an angle of about 20°.

As an example of a suitable projection, the projection 152 in FIG. 17 is formed to extend about 0.35 mm (0.014 inches) from the surface 170 into the main channel portion. The surface 160 is canted toward the wing member 102 at an angle of about 20°. The surface 164 extends away from the surface 170 at an angle of about 75°. The surface 166 is undercut to form an angle of about 70° with the surface 170. When types of slide fastener chains not employing the beads 38 and 40 are substituted, the locking projections have sizes and configurations designed to particularly operate on heel portions of fastening elements in the main channel portion 130.

Figure 6:
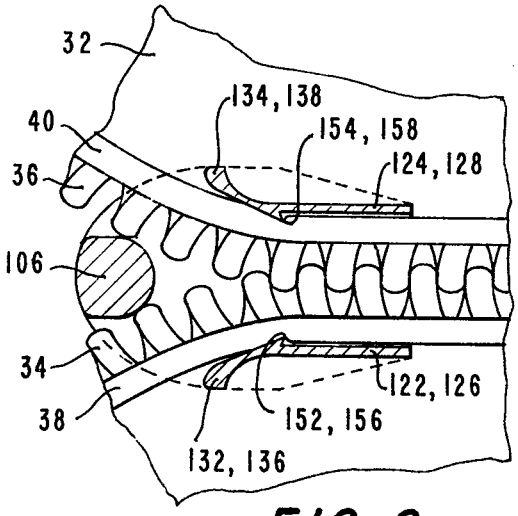
FIG. 6 is a cross-section view of a portion of the slide fastener of FIG. 1 taken similar to the view in FIG. 4 but with the slider assembled on the slide fastener chain and particularly illustrating locking action of the slider.
Figure 8:
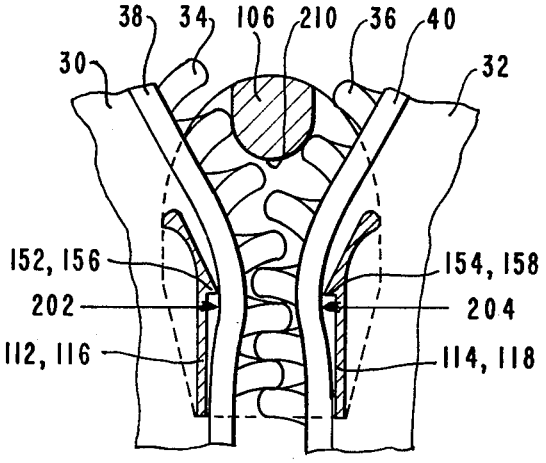
FIG. 8 is a cross-section view of the slide fastener portion of FIG. 6 similar to the view of FIG. 6 but illustrating the improved opening operation of the slider in accordance with the invention.

In operation of the slider 100 on a woven spiral-type slide fastener chain when crosswise forces are applied to the tapes 30 and 32 and the slider is in a closed position, the beads 38 and 40 are forced onto the projections 152, 154, 156 and 158 as shown in FIG. 6 resulting in a locking action to prevent the slider from moving in an opening direction which otherwise would occur due to the camming forces applied by the beads 38 and 40 on the diverging flange portions 132, 134, 136 and 138. During opening movement of the slider as shown in FIG. 8, the inner edges of the tapes 30 and 32 tend to move inward toward each other at the junction between the main channel portion and the branch channel portions as shown by the arrows 202 and 204. The fastening elements 38 and 40 are spread apart permitting the elements to intermesh to a greater extent. This inward movement 202 and 204 is caused by elastic forces in the stringers which result in a natural tendency to distribute bending stresses over a larger length of the stringer, i.e., a sharp bending stress, such as at the division point in the Y-shaped channel of the slider, applied at one point in an elongated, elastic article will result in a rounded curvature throughout a substantial length of the article rather than a sharp bend at one point when the article is allowed to make such a larger rounded curvature. Due to the location of the projections at the juncture in the Y-shaped channel, the beads tend to disengage the locking projections permitting relatively easy opening movement of the slider. Under conditions of high crosswise force on the slide fastener chain, camming forces of the beads 30 and 32 on the diverging flange portions 132, 134, 136 and 138 reduce the slider opening force necessary to overcome the retarding force of the projections.

It is noted that the placement of the locking projections 152, 154, 156 and 158 extending into the main channel portion 130 also permits the locking projections to be effective even when the upper ends of the slide fastener tapes 30 and 32 are secured together which prevents operation of prior art self-locking slide fasteners having notches or projections formed on the diverging flange portions. Furthermore having the locking projections 152, 154, 156 and 158 extending into outer regions of the main channel portion 130 causes the crosswise forces to increase the engagement between the locking projections and the beads 38 and 40; such increased engagement does not occur in prior art locking pawls extending into center portions of the main channel portions.

Figure 7:
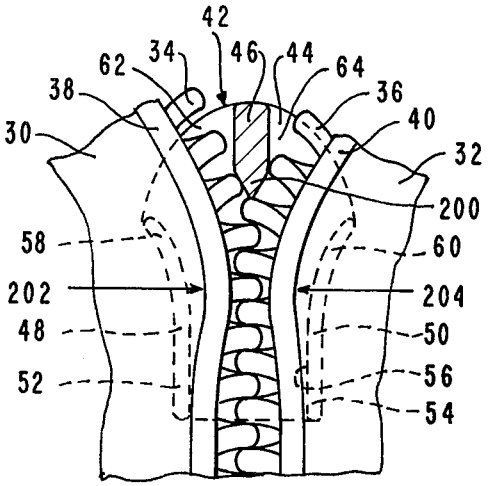
FIG. 7 is a cross-section view of a prior art slide fastener taken at a view similar to the view of FIG. 6 but illustrating a defective opening operation of the prior art slider.

It has been discovered that the cause for hang-up of sliders on larger size spiral coil type fasteners during opening movement of the sliders is caused by engagement of head portions of the fastening elements 34 and 36 with the extreme inner edge or surface of the divider post 46 as shown at 200 in FIG. 7. In larger size coil type slide fasteners, the ratio of the thickness of the monofilament relative to the size of the coil is substantially less than the ratio of the monofilament thickness to coil size in smaller sizes of spiral type slide fasteners. This lesser ratio results in longer, narrower fastening elements 34 and 36 and more inward relative movement, as shown by the arrows 202 and 204, of the fastening elements 34 and 36 in the slider. This tendency to hang-up could be overcome by utilizing a greater thickness of monofilament in larger coil type spiral slide fasteners; however, such greater thickness of monofilament greatly increases material and production costs compared to use of a lesser thickness of monofilament.

Figure 2:
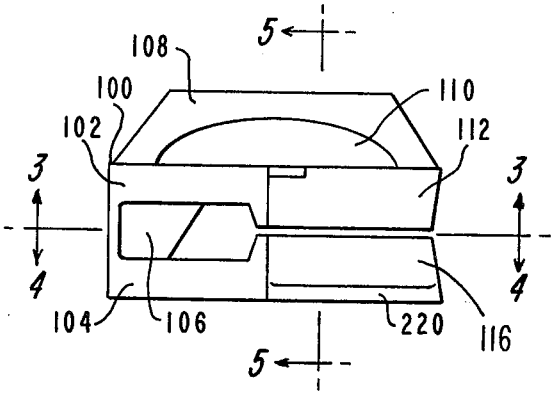
FIG. 2 is a side elevation view of a slider in the slide fastener of FIG. 1.
Figure 3:
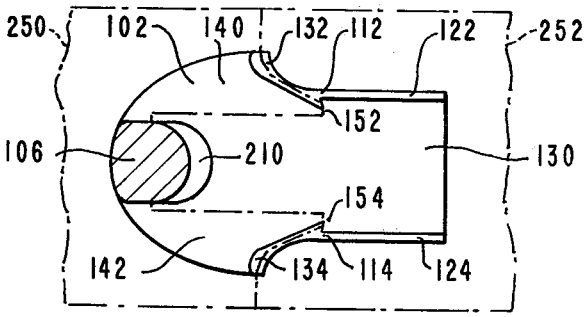
FIG. 3 is a cross-section view taken at line 3—3 in FIG. 2.
Figure 4:
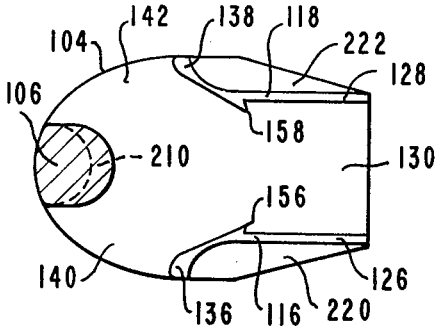
FIG. 4 is a cross-section view taken at line 4—4 in FIG. 2.
Figure 5:
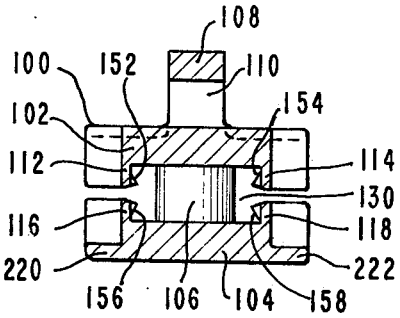
FIG. 5 is a cross-section view taken at line 5—5 in FIG. 2.

In order to overcome the tendency of sliders to hang-up during opening movement on larger coil type slide fastener chain as well as on other types of slide fastener chain subject to such hang-up, the working or inner surface 210 of the slider post 106 is formed (1) with a rounded or generally half cylindrical shape, and (2) at an incline or acute angle extending from one of the wing members 102 and 104 to the other wing member as shown in FIGS. 2, 3 and 4. Preferably the innermost portion or line of the working surface 210 extends at an angle in the range from 45° to 70° relative to the wing members 102 and 104 throughout substantially the entire height of the surface 210, and especially preferably extends at an angle of about 60° for coil type slide fasteners.

Figure 9:
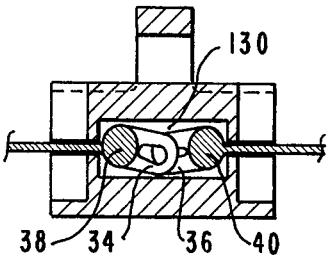
FIG. 9 is another cross-section view of the slide fastener portion of FIG. 8 during the opening action illustrated in FIG. 8 taken similar to the view of FIG. 5.
Figure 10:
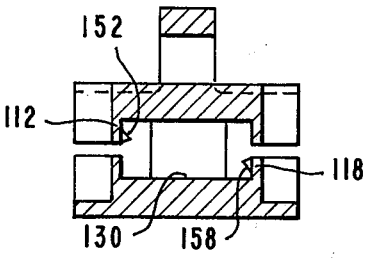
FIG. 10 is a cross-section view similar to the view of FIG. 5 of a modified slider in accordance with the invention.

The fastening elements 34 and 36 engage the outer portions of the working surface 210 and also have their distal ends or head portions pivoted downward about the beads 38 and 40 (see FIG. 9) by camming forces from the working surface 210 during opening movement of the slider; it is found that the reduction in hang-up is substantially greater when the rounded surface 210 is inclined than is possible by rounding of the working surface 210 in the absence of an incline extending substantially the full height between the upper and lower wing members.

The slider 100 illustrated in the drawings does not include any pull pivotally attached thereto. This slider is intended for employment in a slide fastener attached to an upholstered seat cover such as those employed in automobiles, etc. Normally such slide fasteners when closed are rarely opened, and thus the advantage of not having a pull extending from the article where it can engage other articles or otherwise be a nuisance is greater than the disadvantage of requiring a separate tool to open the slide fastener. However, a pull such as those normally employed on prior art sliders can be attached and used on the slider 100 in a conventional manner.

Figure 14:
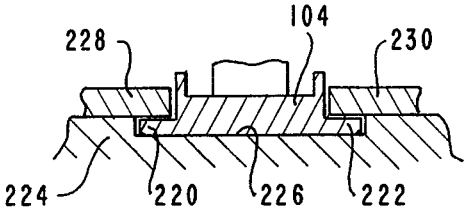
FIG. 14 is a cross-section view of a lower portion of the slider of FIG. 5 and an upper portion of a holder for supporting the slider in position for assembly on a slide fastener chain.
Figure 15:
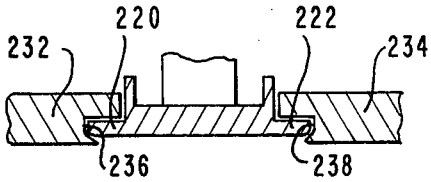
FIG. 15 is a view similar to FIG. 14 but showing a different possible modification of the holder for holding the slider.
Figure 16:
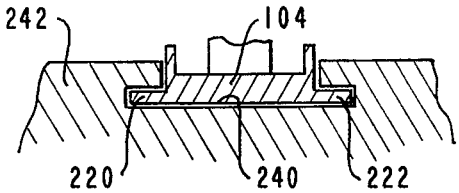
FIG. 16 is a view similar to FIG. 14 illustrating a second modified structure of the holder for supporting the slider.

In the assembly of a prior art slider onto a slide fastener chain, the pull of the prior art slider is normally held by a holder mechanism which supports the slider in a position for easy installation on the slide fastener chain. The slider 100 does not have a pull to be gripped by the prior art slider holding apparatus but includes laterally extending tabs 220 and 222, FIG. 4, which cooperate with slider holders modified as shown in FIGS. 14, 15 and 16. These tabs 220 and 222 are shown extending outwardly from the lower wing member 104 from edge portions supporting the flanges 116 and 118. The upper surfaces of the tabs 220 and 222 are spaced below the upper edges of the flanges 116 and 118 while the lower surfaces of the tabs 220 and 222 are continuous with the lower surface of the wing member 104. Positioning the tabs 220 and 222 on the edge portions supporting the flanges permits the tabs 220 and 222 to extend laterally from the slider without increasing the total width of the slider. In the slider holer of FIG. 14, the upper end of a slider supporting post 224 is provided with a shallow recess 226 for receiving the lower portion of the slider wing 104 and the tabs 220 and 222 wherein members 228 and 230 engage upper surfaces of the tabs 220 and 222 to hold the slider in the holder without the holderextending above the upper edges of the flanges on the wing member 104; the members 228 and 230 may be movable permitting insertion of the slider, or suitable insertion channels may be provided for permitting insertion of the slider in the holder. In the holder of FIG. 15, a pair of members 232 and 234 have respective facing grooves or channels 236 and 238 configured to receive and engage the respective tabs 220 and 222 to hold the slider; similarly the members 232 and 234 may be movable or the holder may be provided with suitable channel means for directing the slider between the members 232 and 234. A configured opening 240 in a unitary slider holding member 242 of FIG. 16 is shaped to receive both the wing portions 220 and 222 as well as the bottom portion of the wing member 104; suitable entrance channel means must be provided in the member 242 to permit the insertion of the bottom portion of the slider into the channel 240. It is noted that the tabs 220 and 222 could be positioned on the upper wing member 102 rather than on the lower wing member 104.

The present slider can be made in a single casting operation not requiring extra bending or deforming steps which substantially increase the cost of the slide fastener. As shown in phantom lines in FIG. 3, die core members 250 and 252 are utilized to form the Y-shaped channel in the slider. The projections 152, 154, 156 and 158 as well as the rounded inclined working surface 210 and tabs 220 and 222 are provided by making relatively simple modifications in the contours of die members utilized to cast sliders in the prior art.

Figure 13:
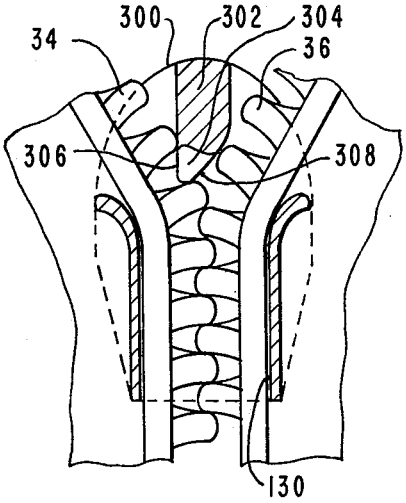
FIG. 13 is a cross-section view similar to the view of FIG. 6 but of a third modified slide fastener in accordance with the invention.

In the modified slider 300 shown in FIG. 13, a divider post 302 has an asymmetrical projection 304 which extends into one of the branch portions of the Y-shaped divider channel. This projection has one surface 306 which is substantially parallel with the main channel portion in the slider and has another surface 308 which is substantially parallel to the other branch portion of the Y-shaped channel of the slider. This projection 304 permits the fastener elements 34 to be deformed by the surface 306 which is inclined relative to the channel through which the elements 34 pass but prevents or retards the movement of the elements 34 from the main control portion back into the branch portion. When a large size is selected for the projection 304, opening movement of the slider is prevented. When a smaller size is selected for the projection 304, the projection 304 only restricts opening movement of the slider, the slider being movable by the application of sufficient force to pull the fastening elements 34 past the projection 304. The slider 300 contains the normal wing portions and flanges of prior art slide fasteners.

Since many variations, modifications and changes in detail may be made in the described embodiments, it is intended that all matter described in the forgoing description and shown in the drawings be interpreted as illustrative and not in a limiting sense.

What is claimed is:

1. A slider for a slide fastener which has a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion of substantial length and two branch channel portions which diverge from one end of the main channel portion on opposite sides of the divider post, a projection formed on an interior wall of the slider in the main channel portion, said projection extending into an outer lateral region of the one end of the main channel portion for engaging a portion of the chain of the slide fastener to retard opening movement of the slider, and said main channel portion having its other end free of projections.

2. A slider as claimed in claim 1 including a second projection formed on an interior wall of the slider in the main channel portion, said second projection extending into an outer lateral portion of the one end of the main channel portion on a side opposite to the side of the first projection for engaging a portion of the chain of the slide fastener to retard opening movement of the slider.

3. A slider as claimed in claim 2 wherein the main channel portion has a rectangular cross section, and the first and second projections extend into diagonally opposite outer regions of the main channel portion.

4. A slider as claimed in claim 1 wherein the flanges of the slider include four flanges, two of which are mounted on respective opposite lateral edges of each respective wing member and extend toward the other wing member, the projection extends adjacent to one of the four flanges, and the slider includes three additional projections extending adjacent the respective other three flanges, the three additional projections extending into respective outer lateral regions of the one end of the main channel portion for engaging the slide fastener to retard opening movement of the slider.

5. A slider as claimed in claim 1 wherein the projection is mounted on and extends inwardly from one flange of the flanges.

6. A slider for a slide fastener which has a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite ends of the divider post, a projection formed on an interior wall of the slider in the main channel portion, said projection being mounted on and extending inwardly from one flange of the flanges into an outer lateral region of the main channel portion for engaging a portion of the chain of the slide fastener to retard opening movement of the slider, said one flange including a first flange portion extending parallel to the main channel portion and a second channel portion extending outward and parallel to one branch channel, and said projection having one surface in a plane of an inner surface of the second flange portion and a second surface transverse to an inner surface of the first flange portion.

7. A slider as claimed in claim 6 wherein the projection has a third surface extending parallel to the direction of the main channel portion but obliquely to the flange and the outer walls of the main channel portion, said first, second and third surfaces of the projection forming a pyramidal point on the projection.

8. A slider as claimed in claim 6 or 7 wherein the second surface is slightly undercut with respect to the projection.

9. A slider as claimed in claim 6 or 7 wherein the projection has a surface extending from the inner distal edge of the one flange at an oblique angle toward the one wing member.

10. A slider for a slide fastener which has a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, a projection formed on an interior wall of the slider in the main channel portion, said projection extending from an inner surface of one of the first and second wing members into an outer lateral region of the main channel portion for engaging a portion of the chain of the slide fastener to retard opening movement of the slider, and said projection having a first surface extending at an incline from the inner surface of the one wing member at one of the branch channel portions and a second surface extending transverse to the main channel portion and intersecting the one surface for forming a sharp edge for engaging a portion of the slide fastener chain.

11. A slider as claimed in claim 10 wherein the projection is contiguous to one flange of the flanges.

12. A slider for a slide fastener with a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, a projection formed on an interior wall of the slider in the main channel portion, said projection extending into an outer lateral region of the main channel portion for engaging a portion of the chain of the slide fastener to retard opening movement of the slider, said connecting divider post having a surface which includes a substantially straight line extending between the first and second members, said line defining the division between the two branch channel portions, and said line extending at an oblique angle to the first and second wing members.

13. A slider as claimed in claim 12 wherein the connecting divider post has a rounded inner working surface.

14. A slider as claimed in claim 1 or 12 including an extension protruding above one of the first and second wing members, said extension having an opening for receiving a tool to operate the slider, and a pair of tabs projecting laterally on opposite sides of one of the first and second members for being engaged by a holder during assembly of the slider on the chain.

15. A slider for a slide fastener which has a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, said connecting divider post having an inner surface which includes a substantially straight line extending between the first and second members, said line defining the division between the two branch channel portions, and said line extending in an oblique angle to the first and second wing members.

16. A slider as claimed in claim 15 wherein the line on the inner surface of the divider post extends at an angle within the range from 45° to 70° relative to the first and second wing members.

17. A slider as claimed in claim 15 or 16 wherein the inner surface of the connecting divider post is rounded in a plane parallel to the main channel portion.

18. A slider as claimed in claim 15 or 16 wherein the inner surface of the connecting divider post is substantially half cylindrical.

19. A slide fastener as claimed in claim 16 wherein the line extends at an angle of about 60° relative to the first and second wing members.

20. A pull-less slider for a slide fastener which has a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member to define narrow slots for receiving the tapes, said flanges and said post defining a Y-shaped channel between the wing members, said Y-shaped channel having a main channel portion and two branch channel portions which diverge from the main channel portion on opposite sides of the divider post, an extension protruding above one of the first and second members, said extension having an opening for receiving a tool to operate the slider, and a pair of tabs projecting laterally on opposite sides of one of the first and second members and spaced sufficiently from the tape receiving slots for being engaged by a holder during assembly of the slider on the chain without the holder extending into a plane defined by the tape receiving slots.

21. A pull-less slider as claimed in claim 20 wherein the pair of tabs extend from respective outer edge portions of the one wing member supporting the flanges adjacent to the flanges such that the tabs extend laterally only to about the widest dimension of the one wing member.

22. A pull-less slider as claimed in claim 20 or 21 wherein the flanges include four flanges, two of which are mounted on respective opposite sides of each respective wing member, the pair of tabs are mounted on the wing member opposite the wing member supporting the extension, and the pair of tabs extend contiguous the bottom surface of the slider along the plane of the bottom surface of the slider.

23. A slider for a slide fastener which has a chain including a pair of tapes and interlocking fastening elements mounted on inner edges of the tapes for being opened and closed by the slider, the slider comprising first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, a pointed projection formed on the divider post and extending into one of the branch channel portions adjacent to the junction between the one branch channel portion and the main channel portion, and said projection extending at an oblique angle to the one branch channel portion toward one side channel portion of the main channel portion for permitting movement of the fastening elements on one of the tapes through the one branch channel portion into the main branch channel and for restricting movement of the fastening elements on the one tape from the main channel portion through the one branch channel portion.

24. A slider as claimed in claim 23 wherein the pointed projection has one surface parallel to the main channel portion and has a second surface substantially parallel to the opposite branch channel portion.

25. A slide fastener comprising a pair of monofilament coils configured to form a pair of rows of fastening elements, a pair of woven tapes having respective woven beads on inner edges thereof interwoven with the respective pair of coils, and a slider receiving the coils and beads, the slider including first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion of substantial length and two branch channel portions which diverge from one end of the main channel portion on opposite sides of the divider post, a projection formed on an interior wall of the slider in the main channel portion, said projection extending into an outer lateral region of the one end of the main channel portion for engaging the woven beads of the slide fastener to retard opening movement of the slider, and said main channel portion having its other end free of projections.

26. A slide fastener as claimed in claim 25 including a second projection formed on an interior wall of the slider in the main channel portion, said second projection extending into an outer lateral region of the one end of the main channel portion on a side opposite to the side of the first projection for engaging a portion of the chain of the slide fastener to retard opening movement of the slider.

27. A slide fastener as claimed in claim 26 wherein main channel portion has a rectangular cross section, and the first and second projections extend into diagonally opposite outer regions of the main channel portion.

28. A slide fastener as claimed in claim 25 wherein the flanges of the slider include four flanges, two of which are mounted on respective opposite lateral edges of each respective wing member and extend toward the other wing member, the projection extends adjacent to one of the four flanges, and the slider includes three additional projections extending adjacent the respective other three flanges, the three additional projections extending into respective outer lateral regions of the one end of the main channel portion for engaging the slide fastener to retard opening movement of the slider.

29. A slide fastener as claimed in claim 25 wherein the projection is mounted on and extends inwardly from one flange of the flanges.

30. A slide fastener comprising a pair of monofilament coils configured to form a pair of rows of fastening elements, a pair of woven tapes having respective woven beads on inner edges thereof interwoven with the respective pair of coils, and a slider receiving the coils and beads, the slider including first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, a projection formed on an interior wall of the slider in the main channel portion, said projection being mounted on and extending inwardly from one flange of the flanges into an outer lateral region of the main channel portion for engaging the woven beads of the slide fastener to retard opening movement of the slider, said one flange including a first flange portion extending parallel to the main channel portion and a second channel portion extending outward and parallel to one branch channel, and said projection having one surface in a plane of an inner surface of the second flange portion and a second surface transverse to an inner surface of the first flange portion.

31. A slide fastener as claimed in claim 30 wherein the projection has a third surface extending parallel to the direction of the main channel portion but obliquely to the flange and the outer walls of the main channel portion, said first, second and third surfaces of the projection forming a pyramidal point on the projection.

32. A slide fastener as claimed in claim 30 or 31 wherein the second surface is slightly undercut with respect to the projection.

33. A slide fastener as claimed in claim 30 or 31 wherein the projection has a surface extending from the inner distal edge of the one flange at an oblique angle toward the one wing member.

34. A slide fastener comprising a pair of monofilament coils configured to form a pair of rows of fastening elements, a pair of woven tapes having respective woven beads on inner edges thereof interwoven with the respective pair of coils, and a slider receiving the coils and beads, the slider including first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, a projection formed on an interior wall of the slider in the main channel portion, said projection extending from an inner surface of one of the first and second wing members into an outer lateral region of the main channel portion for engaging the woven beads of the slide fastener to retard opening movement of the slider, and said projection having a first surface extending at an incline from the inner surface of the one wing member at one end of the branch channel portions and a second surface extending perpendicular to the main channel portion and intersecting the one surface for forming a sharp edge for engaging a portion of the slide fastener chain.

35. A slide fastener as claimed in claim 34 wherein the projection is contiguous to one flange of the flanges.

36. A slide fastener comprising a pair of monofilament coils configured to form a pair of rows of fastening elements, a pair of woven tapes having respective woven beads on inner edges thereof interwoven with the respective pair of coils, and a slider receiving the coils and beads, the slider including first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, a projection formed on an interior wall of the slider in the main channel portion, said projection extending into an outer lateral region of the main channel portion for engaging the woven beads of the slide fastener to retard opening movement of the slider, said connecting divider post having a surface which includes a substantially straight line extending between the first and second members, said line defining the division between the two branch channel portions, and said line extending at an oblique angle to the first and second wing members.

37. A slide fastener as claimed in claim 36 wherein the connecting divider post has a rounded inner working surface.

38. A slide fastener as claimed in claim 25 or 26 including an extension protruding above one of the first and second wing members, said extension having an opening for receiving a tool to operate the slider, and a pair of tabs projecting laterally on opposite sides of one of the first and second members for being engaged by a holder during assembly of the slider on the chain.

39. A slide fastener comprising a pair of monofilament coils configured to form a pair of rows of fastening elements, a pair of woven tapes having respective woven beads on inner edges thereof interwoven with the respective pair of coils, and a slider receiving the coils and beads, the slider including first and second spaced and superposed wing members each having first and second ends, a connecting divider post extending between and joining the first ends of the first and second wing members, flanges on opposite sides of at least one of the wing members and extending toward the other wing member, said flanges and said post defining a Y-shaped channel between the wing members, said Y-shaped channel having a main channel portion and two branch channel portions which diverge from the main channel portion on opposite sides of the divider post, said connecting divider post having an inner surface which includes a substantially straight line extending between the first and second members, said line defining the division between the two branch channel portions, and said line extending in an oblique angle to the first and second wing members.

40. A slider as claimed in claim 39 wherein the line on the inner surface of the divider post extends at an angle within the range from 45° to 70° relative to the first and second wing members.

41. A slider as claimed in claim 39 or 40 wherein the inner surface of the connecting divider post is rounded in a plane parallel to the main channel portion.

42. A slider as claimed in claim 39 or 40 wherein the inner surface of the connecting divider post is substantially half cylindrical.

43. A slide fastener as claimed in claim 40 wherein the line on the inner surface extends at an angle of about 60° relative to the first and second wing members said line extending in an oblique angle to the first and second wing members.

* * * * *